US011602190B2

(12) United States Patent
Morgan

(10) Patent No.: US 11,602,190 B2
(45) Date of Patent: Mar. 14, 2023

(54) SANDALS

(71) Applicant: HERE'S GOLDEN LTD., Auckland (NZ)

(72) Inventor: Simon Morgan, Auckland (NZ)

(73) Assignee: Here's Golden Ltd, Auckland (NZ)

( * ) Notice: Subject to any disclaimer, the term of this patent is extended or adjusted under 35 U.S.C. 154(b) by 0 days.

(21) Appl. No.: 17/354,467

(22) Filed: Jun. 22, 2021

(65) Prior Publication Data

US 2022/0400808 A1 Dec. 22, 2022

(51) Int. Cl.
*A43B 3/12* (2006.01)

(52) U.S. Cl.
CPC ..... *A43B 3/122* (2013.01); *A43B 3/126* (2013.01); *A43B 3/128* (2013.01)

(58) Field of Classification Search
CPC ..... A43B 3/101; A43B 3/10; A43B 3/105; A43B 3/103; A43B 3/12; A43B 3/122; A43B 3/126
USPC ..... 36/11.5; D2/916, 919
See application file for complete search history.

(56) References Cited

U.S. PATENT DOCUMENTS 4,172,330 A * 10/1979 Kao ..... A43B 3/103 36/11.5
4,525,940 A * 7/1985 Mochizuki ..... A43B 5/08 36/8.1
5,802,738 A * 9/1998 Ferniani ..... A43B 3/103 36/11.5
5,852,885 A * 12/1998 Ferniani ..... A43B 3/103 36/11.5
6,874,254 B1 * 4/2005 Silvera ..... A43B 3/102 36/76 R
9,301,568 B2 * 4/2016 Law ..... A43B 3/103
9,380,836 B1 * 7/2016 Vigil ..... A43B 3/122
D854,792 S * 7/2019 McLellan ..... D2/917
2008/0086825 A1 * 4/2008 Mullen ..... A43B 3/103 12/142 Q
2011/0099840 A1 * 5/2011 Aveni ..... A43B 3/248 36/11.5
2011/0239484 A1 * 10/2011 Giovannetti ..... A43B 3/103 36/11.5
2011/0314692 A1 * 12/2011 Marmar ..... A43B 3/108 36/11.5
2011/0314694 A1 * 12/2011 Marmar ..... A43B 3/103 36/11.5
2013/0019496 A1 * 1/2013 Mizrahi-Shapiro ..... A43B 1/0027 36/11.5
2014/0352171 A1 * 12/2014 Hillyer ..... A43B 3/105 36/11.5
2015/0223551 A1 * 8/2015 Munro ..... A43B 3/108 36/11.5
2017/0135436 A1 * 5/2017 Munro ..... A43B 3/246
2018/0295929 A1 * 10/2018 McLellan ..... A43B 3/103
2019/0261726 A1 * 8/2019 L'Hermet ..... A43B 3/10
(Continued)

FOREIGN PATENT DOCUMENTS

JP 2001-078805 3/2007

*Primary Examiner* — Marie D Bays
(74) *Attorney, Agent, or Firm* — Eric Karich; Karich & Associates

(57) ABSTRACT

A sandal has a sole with a front hole and a pair of rear holes, a toe thong that includes a center portion and a pair of side straps, the center portion having an oversized front plug, and each of the side straps having a rear plug.

1 Claim, 2 Drawing Sheets

(56) References Cited

U.S. PATENT DOCUMENTS

| | | | |
|---|---|---|---|
| 2020/0128905 | A1 | 4/2020 | Lin |
| 2020/0163404 | A1 | 5/2020 | Lien et al. |

* cited by examiner

SANDALS

BACKGROUND OF THE INVENTION

Field of the Invention

This invention relates generally to sandals, and more particularly to an improved sandal that is strongly resistant to a central plug of the sandal being pulled through a sole of the sandal while being worn by a user.

Description of Related Art

Sandals having toe thongs, also known as flip-flops, are typically constructed by pulling plugs of the toe thong downwardly through holes formed in the sandal. The plugs must be larger than each hole to ensure the toe thong doesn't separate from the sole, but still small enough to be pulled through the holes. A tool may be used to narrow and taper the plug, but the usefulness of the tool is capped if the plug is significantly larger than the holes.

This method of manufacture is widely implemented, but pressure on the plugs too-frequently results in the sandal falling apart during wear. There is a need for a sandal that is manufactured to prevent the plugs from easily pulling out of the sole. The present invention fulfills these needs and provides further advantages as described in the following summary.

SUMMARY OF THE INVENTION

The present invention teaches certain benefits in construction and use which give rise to the objectives described below.

The present invention provides a sandal comprising a sole having a front hole, and a pair of rear holes, a toe thong that includes a center portion and a pair of side straps, the center portion having an oversized front plug, and each of the side straps having a rear plug.

A primary objective of the present invention is to provide a sandal having advantages not taught by the prior art.

Another objective is to provide a sandal having a front plug that is oversized and significantly larger than prior art front plugs, to prevent pullouts where the front plug is pulled through the front hole of the sole.

A further objective is to provide a sandal having a unique method of manufacture wherein a front plug does not pass through any holes in the sole of the sandal.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, sandals having a front plug that is oversized and significantly larger than prior art front plugs, to prevent pullouts where the front plug is pulled through the front hole of the sole. The invention also includes a unique method of manufacture wherein the front plug does not pass through any holes in the sole of the sandal during assembly, as described in greater detail below.

Figure 1:
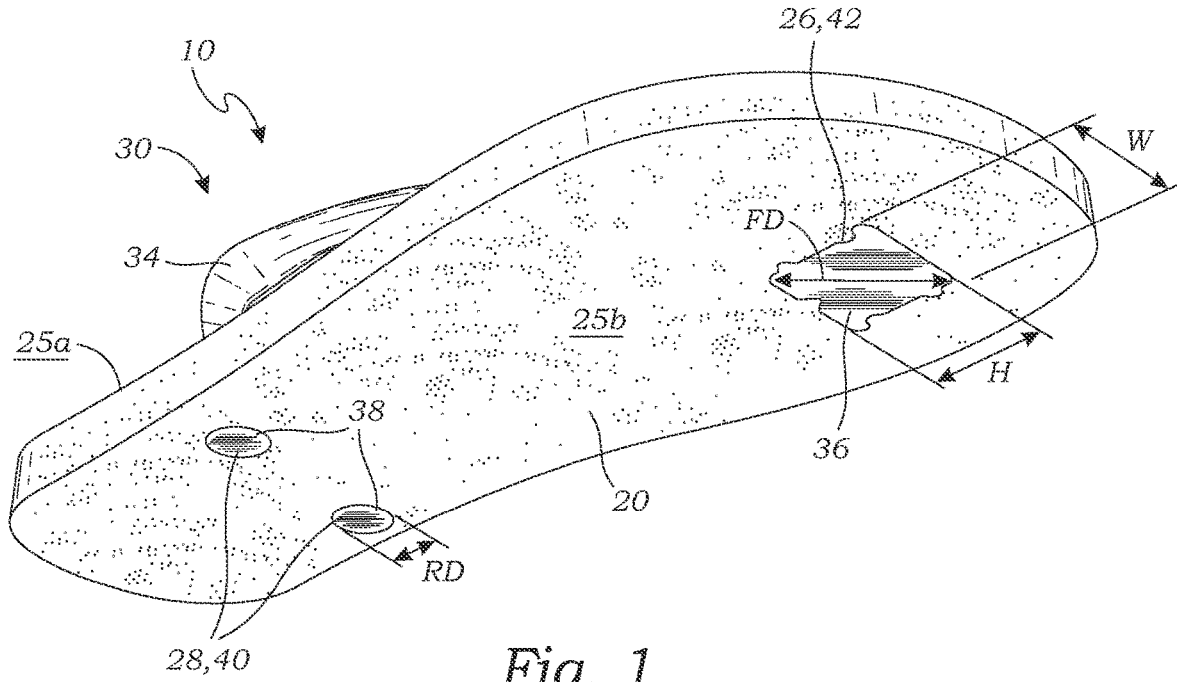
FIG. 1 is a bottom perspective view of a sandal according to one embodiment of the present invention.
Figure 2:
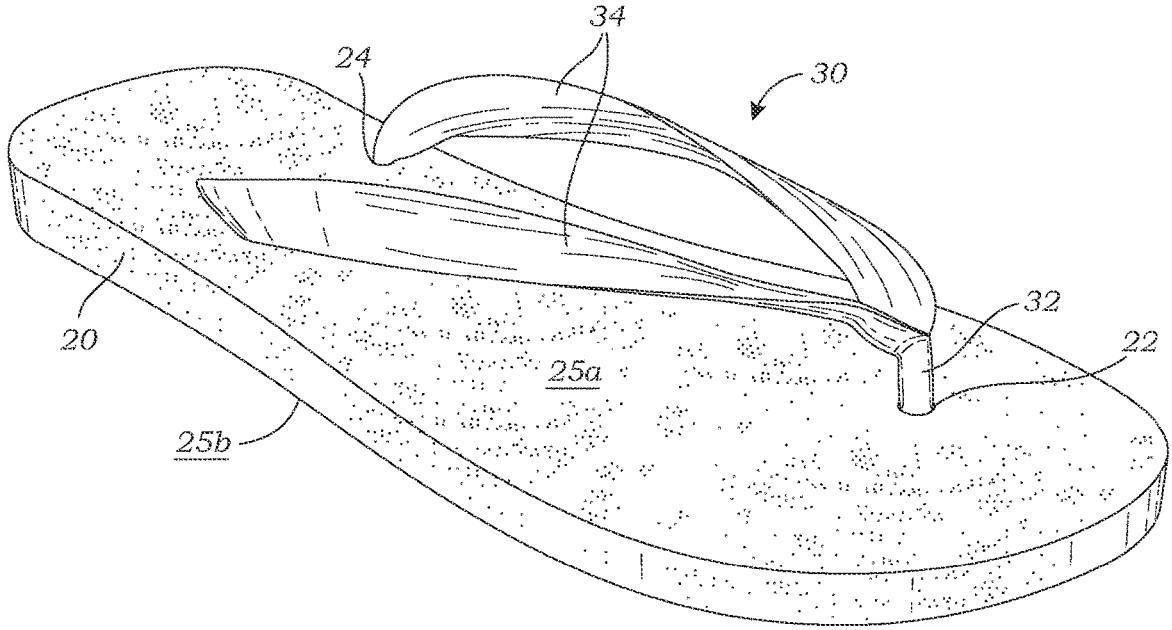
FIG. 2 is a top perspective view thereof.

FIG. 1 is a bottom perspective view of a sandal 10 according to one embodiment of the present invention, and FIG. 2 is a top perspective view thereof. As shown in FIGS. 1-2, the sandal 10 comprises a sole 20 and a toe thong 30. The sole 20 includes a front hole 22 and a pair of rear holes 24, and is similar to prior art soles of similar sandals. The toe thong 30 includes a center portion 32 and a pair of side straps 34. Each of the side straps 34 have a rear plug 38. The general construction of the toe thong 30 and the rear plugs 38 are also similar to prior art sandals; however, in the present invention, the center portion 32 includes a front plug 36 which is oversized, much larger than prior art front plugs.

Figure 3:
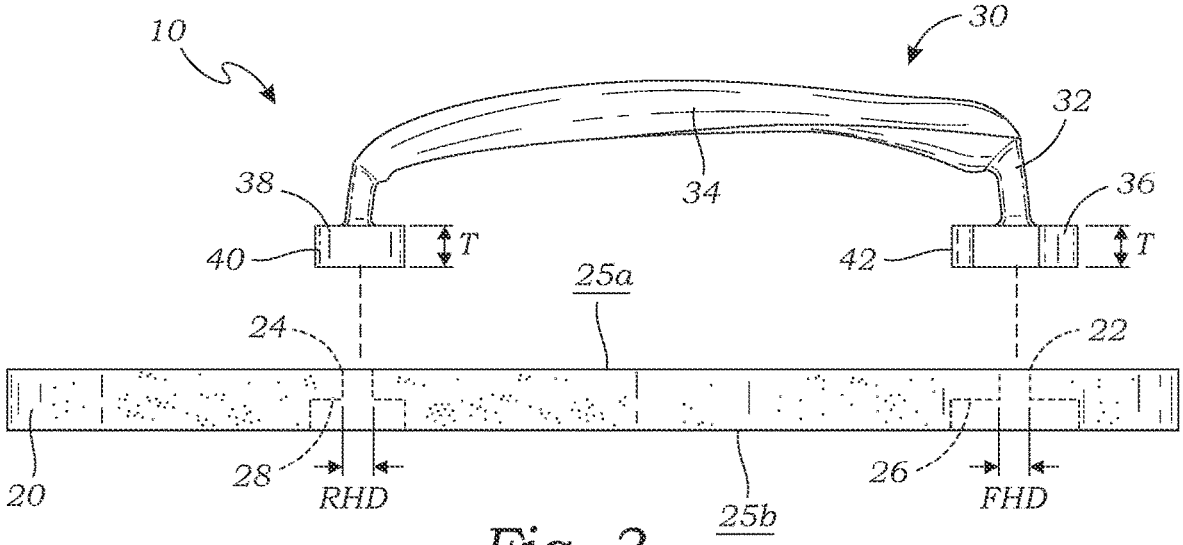
FIG. 3 is an exploded side elevational view of the sandal.

For the purposes of this application, the term "oversized" is defined to mean having at least one dimension, such as a height H or a width W, that is more than three times as large as a diameter FHD of the front hole 22 (shown in FIG. 3).

As shown in FIG. 1, in this embodiment, the rear plugs 38 have a rear diameter RD, and the front plug 36 has a front diameter FD, the width W, and the height H. The diameters of the rear and front holes 24 and 22 of the sole 20 are shown in FIG. 3 and discussed in greater detail below.

In this embodiment, the sole 20 is formed of a resilient material, such as rubber, polyethylene, ethylene vinyl acetate (EVA) or polyurethane foam, etc., a composite of these, or any other suitable materials known in the art. Furthermore, a top surface 25*a* of the sole 20 may be a different material than a bottom surface 25*b*, i.e., having different degrees of cushioning, different surface textures, etc. In some embodiments, said surface textures may be custom molded on the top and/or bottom surfaces 25. In this embodiment, the center portion 32 of the toe thong 30 is in the form of a slightly flared resilient joint, but in other embodiments may be rigid, or soft as in cloth, and/or may include additional structures known in the art (e.g., a sealing portion, flange, etc.). Additional features may also be included in the sole 20 and/or toe thong 30, such as padding, arch support, ornamental features, etc. Furthermore, additional straps may be included, such as a heel strap or a securing strap, or any other similar features, as deemed suitable by one skilled in the art.

As shown in FIG. 1, in this embodiment, the rear plugs 38 include a rounded perimeter edge 40 having the rear diameter RD, and the front plug 36 includes a generally rectangular perimeter edge 42 having the front diameter FD. However, in other embodiments, the rear and front plugs 36 and 38 may be any suitable shape, e.g., both generally rectangular or rounded, elongated, irregular, etc. or any other suitable shape that may be formed as a plug of the toe thong 30. In some embodiments, H and W of the front plug 36 are approximately equal in length, but as discussed above, they may also be different lengths, or the front plug 36 may include additional dimensions (i.e., having additional sides). In some embodiments, H and W are each more than 20 mm, preferably between approximately 20-40 mm in length. In this embodiment, H and W are each approximately 25 mm.

In some embodiments, RD of the rear plugs 38 is between approximately 5-20 mm in diameter, and in this particular embodiment RD is approximately 14 mm. Obviously, other sizes may be implemented, depending on the size of the sole 20, and the diameter of the front and rear holes 22 and 24 (FHD and RHD, respectively, best shown in FIG. 3 and discussed below). In the current embodiment, the front plug 36 is at least twice as large as the rear plug 38 in at least one dimension and/or diameter, depending upon the shape of the plugs.

FIG. 3 is an exploded side elevational view of the sandal 10. As shown in FIG. 3, the front and rear plugs 36 and 38 of the toe thong 30 each have a height T, and the front and rear holes 22 and 24 have the FHD and RHD, respectively. In some embodiments, T may be between approximately 2-6 mm in length, in this embodiment 4 mm. As shown in FIG. 3, the front plug 36 is integrally formed with the center portion 32, as is the standard construction for flip-flop type footwear.

In some embodiments, FHD and RHD are both between approximately 5-10 mm, in this embodiment approximately 7.5 mm As shown in FIG. 3, in some embodiments, a front recess 26 and a pair of rear recesses 28 are formed in the sole 20, the recesses being adapted to receive the front and rear plugs 36 and 38, respectively. As described above, in some applications of the present invention, the sole 20 may be formed of a resilient material, which enables the front and rear recesses 26 and 28 to be approximately the same in diameter as FD and RD, respectively. Alternatively, the front and rear recesses 26 and 28 may be slightly greater in diameter than FD and RD.

Figure 4:
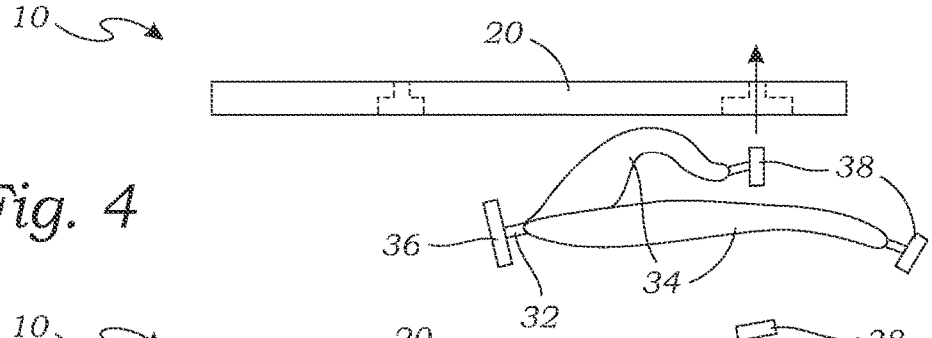
FIGS. 4-7 are side elevational views illustrating the method of manufacture of the sandal of FIG. 1.

FIGS. 4-7 are side elevational views illustrating a method of manufacture of the sandal 10 of FIG. 1. As shown in FIG. 4, at a first step of the method, the rear plugs 38 are consecutively inserted upwardly through the front hole 22 from beneath the sole 20. In some embodiments, this may be done by simply pushing/pulling, and in other embodiments an installation tool may be used (not shown), as is well-known in the art.

Figure 5:
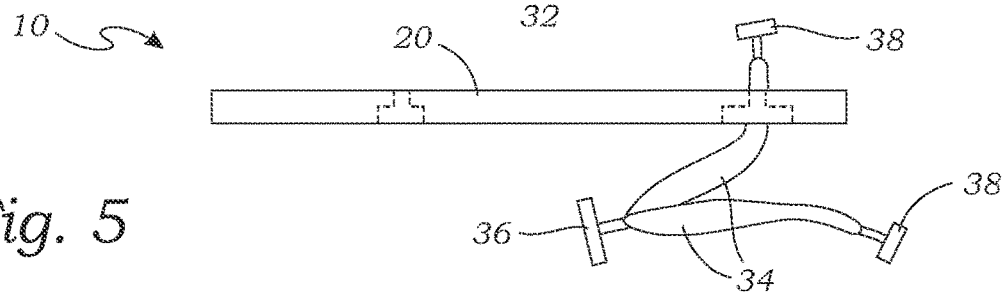
Figure 6:
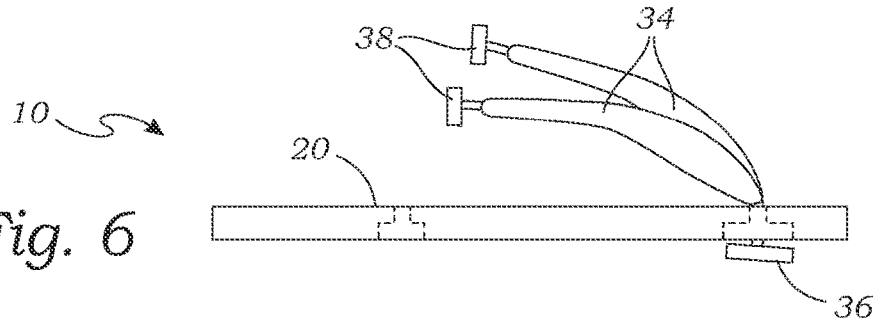
Figure 7:
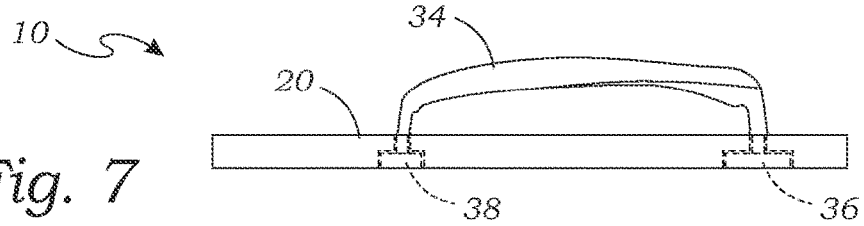

As shown in FIGS. 5-6, at a next step of the method, the pair of side straps 34 are pulled through the front hole 22 following the rear plugs 38, wherein the rear plugs 38 are pulled backwardly toward the rear holes 24 of the sole 20. Next, as shown in FIG. 7, each rear plug 38 is inserted downwardly through one of the rear holes 24 as described in the step of FIG. 4. At this step, the front and rear plugs 36 and 38 may be flush with the front and rear recesses 26 and 28, wherein the sandal 10 is fully constructed and ready for wear, without the front plug 36 passing through any of the front or rear holes 22 or 24.

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A sandal comprising:

a sole having a front hole, and a pair of rear holes;

a toe thong that includes a center portion and a pair of side straps, the center portion having a front plug, and each of the side straps having a rear plug; and wherein the front plug is oversized; and wherein the rear plugs include a rounded perimeter edge, and the front plug includes a generally rectangular perimeter edge.

* * * * *